US009926641B2

(12) United States Patent
Kunihiro et al.

(10) Patent No.: US 9,926,641 B2
(45) Date of Patent: Mar. 27, 2018

(54) METHOD OF MANUFACTURING METAL SHEET HAVING ALLOY PLATED LAYER

(71) Applicant: TOYO KOHAN CO., LTD., Tokyo (JP)

(72) Inventors: Takashi Kunihiro, Kudamatsu (JP); Daisuke Matsushige, Kudamatsu (JP); Eiji Okamatsu, Kudamatsu (JP)

(73) Assignee: TOYO KOHAN CO., LTD, Tokyo (JP)

( * ) Notice: Subject to any disclaimer, the term of this patent is extended or adjusted under 35 U.S.C. 154(b) by 0 days.

(21) Appl. No.: 14/427,542

(22) PCT Filed: Aug. 28, 2013

(86) PCT No.: PCT/JP2013/072954
§ 371 (c)(1),
(2) Date: Mar. 11, 2015

(87) PCT Pub. No.: WO2014/061352
PCT Pub. Date: Apr. 24, 2014

(65) Prior Publication Data

US 2015/0247254 A1 Sep. 3, 2015

(30) Foreign Application Priority Data

Oct. 15, 2012 (JP) ..... 2012-227647

(51) Int. Cl.
*C25D 3/56* (2006.01)
*C25D 17/10* (2006.01)
(Continued)

(52) U.S. Cl.
CPC ..... *C25D 17/10* (2013.01); *C25D 3/562* (2013.01); *C25D 7/0614* (2013.01); *C25D 7/0642* (2013.01); *C25D 17/12* (2013.01)

(58) Field of Classification Search
CPC ..... C25D 17/10; C25D 17/12
See application file for complete search history.

(56) References Cited

U.S. PATENT DOCUMENTS 1,904,732 A * 4/1933 Haueisen ..... C25D 3/565 205/244
4,189,359 A * 2/1980 Limare ..... C22C 1/0433 204/293

(Continued)

FOREIGN PATENT DOCUMENTS

CN 101302644 A 11/2008
CN 101855390 A 10/2010

(Continued)

OTHER PUBLICATIONS

European Search report dated May 30, 2016 in application No. 13847766.6 is provided; pp. 1-8.

(Continued)

*Primary Examiner* — Brian W Cohen
(74) *Attorney, Agent, or Firm* — Muncy, Geissler, Olds & Lowe P.C.

(57) ABSTRACT

There is provided a method of manufacturing a metal sheet having an alloy plated layer, the method including a step of passing a metal strip continuously through a plating bath to perform electroplating in the plating bath, the plating bath including a plating liquid and an anode, the plating liquid containing two or more kinds of metal ions for forming the alloy plated layer, wherein an anode obtained by mixing two or more kinds of metal pellets is used as the anode, the metal pellets being formed of respective metals that form the alloy plated layer, wherein a mixing ratio of each metal pellet that constitutes the anode is determined based on a total surface area ratio of each metal pellet in the anode so that a dissolution ratio of each metal pellet that constitutes the (Continued)

anode is a dissolution ratio corresponding to a weight ratio of each metal that constitutes the alloy plated layer.

4 Claims, 8 Drawing Sheets

(51) Int. Cl.
*C25D 17/12* (2006.01)
*C25D 7/06* (2006.01)

(56) References Cited

U.S. PATENT DOCUMENTS 4,439,284 A * 3/1984 Walter ..... C25D 21/10 205/148
4,565,611 A * 1/1986 Wagner ..... C25D 3/562 205/259
4,569,731 A * 2/1986 Matsuda ..... C25D 3/565 205/141
2008/0179192 A1* 7/2008 Arvin ..... C25D 17/12 205/238
2009/0229380 A1* 9/2009 Yoshimoto ..... C25D 17/02 73/862.333
2010/0206735 A1* 8/2010 Wurm ..... C25D 17/10 205/80
2012/0152750 A1 6/2012 Arvin et al.
2012/0325667 A1 12/2012 Arvin et al.
2013/0065069 A1* 3/2013 Liu ..... C25D 3/562 428/457

FOREIGN PATENT DOCUMENTS

JP 60228693 11/1985
JP 62235494 A 10/1987
JP 06-184797 7/1994
JP 09-241894 A 9/1997
JP 2009-013433 A 1/2009
JP 2012-052212 A 3/2012
WO WO 1997/042667 A1 11/1997

OTHER PUBLICATIONS

Office Action and Search Report dated Jul. 5, 2016 in corresponding CN Application 201380053926.0, with English translation (12 pages total).

* cited by examiner (A) Example 1

(B) Example 2

(C) Example 3

(A) Comparative Example 1

(A) Comparative Example 2

METHOD OF MANUFACTURING METAL SHEET HAVING ALLOY PLATED LAYER

TECHNICAL FIELD

The present invention relates to a method of manufacturing a metal sheet having an alloy plated layer.

BACKGROUND ART

Heretofore, there has been known a method of forming an alloy plated layer comprising some metals such as nickel and cobalt on a metal sheet such as a steel sheet by means of electroplating (see Patent Document 1, for example).

PRIOR ART DOCUMENT

Patent Document

[Patent Document 1] WO 1997/042667

SUMMARY OF INVENTION

Problems to be Solved by Invention

A method of industrially manufacturing such a metal sheet having an alloy plated layer may ordinarily be such that a metal strip is continuously fed into a plating bath and electroplating is continuously performed in the plating bath. According to such a method, an alloy plated layer can be continuously formed on the metal strip. In such a method, however, concentrations of metal ions in the plating liquid included in the plating bath may have to be suppressed from varying in order to keep constant the composition of the alloy plated layer to be obtained by continuously forming the alloy plated layer.

A method of suppressing the variations of the concentrations of metal ions in the plating liquid included in the plating bath may be mentioned as a method in which metal salt compound powders are added to the plating liquid and dissolved therein in order to supplement metal ions consumed by forming the alloy plated layer, for example. However, this method may be difficult to continuously carry out the addition of powders. If the powders are preliminarily dissolved in water and the obtained liquids are continuously added, an adjustment may be necessary with consideration for the balance of liquid volumes when suppressing the variations of the concentrations of metal ions because in this case the water is also added to the plating liquid. In addition, even though the consumed metal ions can be supplemented, the counterpart anions also increase in the plating liquid as the metal salt compound powders are added. This may result in a trouble that a target composition and desired properties of the alloy plated layer cannot be obtained. Furthermore, such metal salt compound powders are expensive in general, leading to a problem in that the manufacturing cost will be high.

Another method of suppressing the variations of the concentrations of metal ions in the plating liquid included in the plating bath may be considered as a method in which plural anodes comprising respective metals that constitute the alloy plated layer are used as the anodes (positive electrodes). For example, when a nickel-cobalt alloy plated layer is formed, a method may be exemplified in which nickel electrodes and cobalt electrodes are used as the anodes, i.e., as supply sources for nickel and cobalt ions. According to this method, however, the ratio of nickel ions and cobalt ions to be supplied from these electrodes is determined depending on the number of nickel electrodes and the number of cobalt electrodes, and a problem may arise in that an alloy plated layer having a specific ratio can only be formed. In addition, this method requires a plurality of anodes to be used, and the electric current may have to be controlled for each anode. However, it may be considerably difficult to continue to uniformly flow an electric current through each anode, and a problem may arise in that the alloy plated layer cannot be stably formed.

Still another method of suppressing the variations of the concentrations of metal ions in the plating liquid included in the plating bath may be considered as a method in which pellets comprising an alloy of respective metals that constitute the alloy plated layer are used as the anode (positive electrode). However, there is a problem in that manufacturing of pellets comprising an alloy may not be easy, and in particular, manufacturing of alloy pellets containing a metal of a high melting point may be considerably difficult. In addition, the method using alloy pellets may require using the alloy pellets with a composition ratio depending on a desired alloy plated layer. Problems in this case may be that the alloy pellets are required to be prepared depending on the metal ratio of a desired alloy plated layer and that, when the desired alloy plated layer is changed, the alloy pellets filled in an anode basket may have to be entirely replaced, which will require complicated operation. Furthermore, the method using alloy pellets involves a problem in that the ratio of each metal dissolving from the alloy pellets (dissolution ratio) may not be stabilized depending on the kinds of metals that constitute the alloy pellets, so that the desired alloy plated layer cannot be formed.

The present invention has been made in consideration of such actual circumstances, and an object of the present invention is to provide a method of manufacturing a metal sheet having an alloy plated layer in which method, when the metal sheet having the alloy plated layer is manufactured, the concentrations of metal ions in the plating liquid included in the plating bath can be suppressed from varying and the composition of the alloy plated layer to be obtained can thereby be stabilized.

Means for Solving Problems

As a result of intensive studies to achieve the above object, the present inventors have found that the above object can be achieved by, when passing a metal strip continuously through a plating bath, which comprises an anode and a plating liquid that contains two or more kinds of metal ions for forming the alloy plated layer, to perform electroplating in the plating bath, using an anode obtained by mixing two or more kinds of metal pellets for forming the alloy plated layer as the anode, and controlling a total surface area ratio of each metal pellet, so that a dissolution ratio of each metal pellet that constitutes the anode is constant, thereby to suppress the concentrations of the metal ions in the plating liquid from varying. The inventors have thus accomplished the present invention. Note that "each metal pellet" as used in the present invention refers to a metal pellet or metal pellets comprising each metal.

That is, according to an aspect of the present invention, there is provided a method of manufacturing a metal sheet having an alloy plated layer. The method comprises a step of passing a metal strip continuously through a plating bath to perform electroplating in the plating bath. The plating bath comprises a plating liquid and an anode. The plating liquid contains two or more kinds of metal ions for forming the alloy plated layer. The method is characterized in that an anode obtained by mixing two or more kinds of metal pellets is used as the anode. The metal pellets are formed of respective metals that form the alloy plated layer. The method is also characterized in that a mixing ratio of each metal pellet that constitutes the anode is determined based on a total surface area ratio of each metal pellet in the anode so that a dissolution ratio of each metal pellet that constitutes the anode is a dissolution ratio corresponding to a weight ratio of each metal that constitutes the alloy plated layer.

The method of manufacturing of the present invention may be configured such that, when respective metals that form the alloy plated layer are represented by $M_1$, $M_2$, $M_3$, . . . and $M_n$, the dissolution ratios (unit of %) of respective metal pellets that constitute the anode are represented by $y(M_1)$, $y(M_2)$, $y(M_3)$, . . . and $y(M_n)$, and the weight ratios (unit of %) of respective metals that constitute the alloy plated layer are represented by $z(M_1)$, $z(M_2)$, $z(M_3)$, . . . and $z(M_n)$, the mixing ratio of each metal pellet that constitutes the anode is determined based on the total surface area ratio of each metal pellet in the anode so that the dissolution ratio of each metal pellet that constitutes the anode satisfies a relationship of Expression (1) below for the weight ratio of each metal that constitutes the alloy plated layer in terms of each of the $M_1$, $M_2$, $M_3$, . . . and $M_n$.

$$z(M_x)-21 \leq y(M_x) \leq z(M_x)+21 \quad (1)$$

(where $M_x$ represents any of $M_1$, $M_2$, $M_3$, . . . and $M_n$)

The method of manufacturing of the present invention may be configured such that, when the electroplating is performed in the plating bath while supplementing the metal pellets into the anode, a supplemental ratio of each metal pellet is set to a ratio corresponding to the weight ratio of each metal that constitutes the alloy plated layer.

The method of manufacturing of the present invention may be configured such that each metal pellet to be used has a representative length of 5 to 50 mm and a volume of 60 to 5,000 $mm^3$.

The method of manufacturing of the present invention may be configured such that the alloy plated layer is a nickel-cobalt alloy plated layer and the anode is an anode obtained by mixing a nickel pellet and a cobalt pellet.

The method of manufacturing of the present invention may be configured such that a weight ratio z(Co) (unit of %) of cobalt in the alloy plated layer is within a range of $40 \leq z(Co) \leq 60$, and the mixing ratios of the nickel pellet and the cobalt pellet that constitute the anode are determined such that a total surface area ratio x(Co) (unit of %) of the cobalt pellet satisfies Expressions (2) and (3) below in relation to the z(Co) and a dissolution ratio y(Co) (unit of %) of the cobalt pellet that constitutes the anode.

$$z(Co)-21 \leq y(Co) \leq z(Co)+21 \quad (2)$$

$$y(Co)=-0.8x(Co)^2/100+1.8x(Co) \quad (3)$$

Effect of Invention

According to the present invention, when a metal sheet having an alloy plated layer is manufactured, an anode obtained by mixing two or more kinds of metal pellets for forming the alloy plated layer is used as the anode to be used for the electroplating, and the total surface area ratio of each metal pellet is controlled. Therefore, the concentrations of metal ions in the plating liquid included in the plating bath can be suppressed from varying, and the composition of the alloy plated layer to be obtained can thereby be stabilized.

MODE(S) FOR CARRYING OUT THE INVENTION

Embodiments according to the present invention will hereinafter be described with reference to the drawings.

Figure 1:
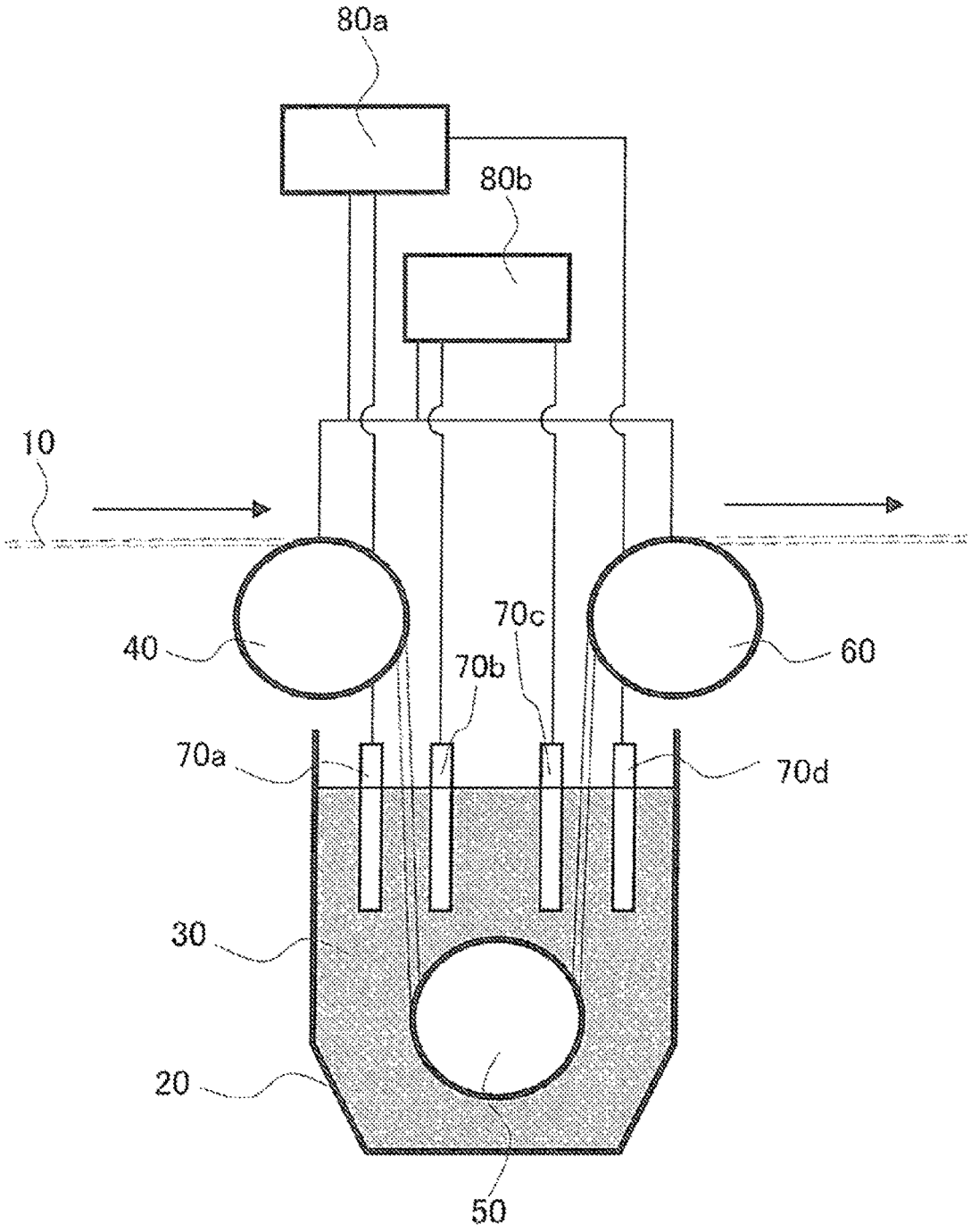
FIG. 1 is a diagram showing an example of a plating line to be used in the present embodiment.

FIG. 1 is a diagram showing an example of a plating line to be used in the present embodiment. The plating line according to the present embodiment is a line for forming alloy plated layers on a metal strip 10. As shown in FIG. 1, as the metal strip 10 is continuously fed into a plating bath 20 comprising a plating liquid 30 by means of a conductor roll 40, electroplating is performed in the plating bath 20 so that the alloy plated layers are continuously formed on the metal strip 10.

As shown in FIG. 1, the plating line according to the present embodiment comprises: 10 the conductor roll 40 for carrying the metal strip 10 into the plating bath 20; a sink roll 50 for turning the traveling direction of the metal strip 10 in the plating bath 20; and a conductor roll 60 for pulling out the metal strip 10 from the plating bath 20. In the present embodiment, among these rolls the conductor rolls 40 and 60 are electrically connected to rectifiers 80*a* and 80*b*, and a cathode current is supplied to the conductor rolls 40 and 60 from an external power source (not shown) via the rectifiers. This allows a direct current from the external power source to be applied to the metal strip 10 via the conductor rolls 40 and 60.

Four anodes 70*a* to 70*d* are immersed in the plating bath 20. Among these four anodes 70*a* to 70*d* the anodes 70*a* and 71*d* are electrically connected to the rectifier 80*a*, and the anodes 70*b* and 70*c* are electrically connected to the rectifier 80*b*. Anode currents are thus supplied from the external power source (not shown) to the anodes 70*a* to 70*d* via the rectifiers 80*a* and 80*b*.

The current flows along the metal strip 10 due to the action of the conductor rolls 40 and 60. In this current flowing state, the metal strip 10 is carried into the plating liquid 30 in the plating bath 20 thereby to allow the four anodes 70*a* to 70*d* to act to perform alloy plating, and the alloy plated layers are formed on the metal strip 10.

In the present embodiment, the metal strip 10 is not particularly limited. Examples of the metal strip 10 to be used include various metals, such as steel sheet, tin-free steel, aluminum alloy sheet, zinc plated steel sheet, zinc-cobalt-molybdenum composite plated steel sheet, zinc-nickel alloy plated steel sheet, zinc-iron alloy plated steel sheet, alloyed hot-dip galvanized steel sheet, zinc-aluminum alloy plated steel sheet, zinc-aluminum-magnesium alloy plated steel sheet, nickel plated steel sheet, copper plated steel sheet, and stainless steel sheet.

In the present embodiment, the alloy plated layer to be formed on the metal strip 10 is also not particularly limited. In view of availability of metal pellets for forming the anodes 70*a* to 70*d* to be described later and the stability of the metal pellets, etc, examples of the alloy plated layer include nickel-cobalt alloy plated layer, nickel-tin alloy plated layer, nickel-zinc alloy plated layer, copper-nickel alloy plated layer, tin-zinc alloy plated layer, tin-copper alloy plated layer, tin-cobalt alloy plated layer, copper-zinc alloy plated layer, and copper-cobalt alloy plated layer. Among them, the nickel-cobalt alloy plated layer is preferable because a high conductivity can be ensured when it is used for a container for batteries. In this case, it is preferred that the nickel-cobalt alloy plated layer has a content ratio of cobalt (z(Co)) within a range of 40 to 60 wt % ($40 \leq z(Co) \leq 60$). The content ratio of cobalt being within the above range allows to ensure a high conductivity while preventing the dissolution of cobalt into an electrolytic liquid when the nickel-cobalt alloy plated layer is used for a container for batteries.

An appropriate plating liquid may be used as the plating liquid 30 depending on the type and/or the alloy composition of the alloy plated layer to be formed on the metal strip 10. There may ordinarily be used a plating liquid containing ions of respective metals that constitute the alloy plated layer to be formed on the metal strip 10. For example, when the alloy plated layer to be formed on the metal strip 10 is a nickel-cobalt alloy plated layer, the plating liquid 30 to be used may be a plating bath based on a Watts bath which contains nickel sulfate, nickel chloride, cobalt sulfate, and boric acid. The compounding amounts in this case may be within ranges of nickel sulfate: 10 to 300 g/L, nickel chloride: 20 to 60 g/L, cobalt sulfate: 10 to 250 g/L, and boric acid: 10 to 40 g/L. The present embodiment may be modified such that: a larger amount of the plating liquid 30 than the volume of the plating bath 20 is prepared; a part of the prepared plating liquid 30 is stored in a plating liquid bath (not shown) placed outside the plating bath 20; and electrolytic treatment is performed while circulating the plating liquid between the plating liquid bath and the plating bath 20.

In the present embodiment, an anode obtained by mixing two or more kinds of pellets of metals for forming the alloy plated layer on the metal strip 10 is used as each of the anodes 70*a* to 70*d*. That is, when the alloy plated layer to be formed on the metal strip 10 comprises an alloy of two kinds of metals, i.e., a metal $M_1$ and a metal $M_2$, for example, a mixture of pellets of the metal $M_1$ and pellets of the metal $M_2$ may be used. Details of the anodes 70*a* to 70*d* will be described later.

The rectifiers 80*a* and 80*b* are not particularly limited. Known rectifiers may be used depending on the magnitudes of currents to be supplied to the conductor rolls 40 and 60 and the anodes 70*a* to 70*d* and/or the voltages.

According to the present embodiment, electroplating is performed for the metal strip 10 and the alloy plated layers are formed on the metal strip 10, as will be described below.

First, the metal strip 10 is carried into the plating bath 20 by means of the conductor roll 40, and further carried, in the plating liquid 30 in the plating bath 20, between the anodes 70*a* and 70*b* immersed in the plating liquid 30. When passing through between the anodes 70*a* and 70*b*, the metal strip 10 faces the anodes 70*a* and 70*b*, and a direct current applied from the external power source via the conductor rolls 40 and 60 acts to perform electroplating so 15 that the formation of the alloy plated layers is performed.

After the anodes 70*a* and 70*b* act to perform electroplating, the metal strip 10 is turned to the reverse traveling direction by means of the sink roll 50 before being carried between the anodes 70*c* and 70*d* immersed in the plating liquid 30. When passing through between the anodes 70*c* and 70*d*, the metal strip 10 faces the anodes 70*c* and 70*d*, and the direct current applied from the external power source via the conductor rolls 40 and 60 acts to perform electroplating so that further formation of the alloy plated layers is performed. The metal strip 10 is then pulled out by the conductor roll 60. According to the present embodiment, the alloy plated layers are thus formed on both sides of the metal strip 10.

FIG. 1 shows only the plating bath 20 as the plating line used in the present embodiment. In an alternative embodiment, the plating line may be configured to have a degreasing bath to perform degreasing of the metal strip 10, a degreasing liquid rinsing bath, an acid cleaning bath to perform acid cleaning, and an acid cleaning liquid rinsing bath, preliminary to the electroplating in the plating bath 20. In this case, the metal strip 10 is carried into the degreasing bath in which the degreasing is performed, and thereafter carried into the degreasing liquid rinsing bath in which the degreasing liquid is rinsed away. Further, the metal strip 10 is carried into the acid cleaning bath in which the acid cleaning is performed, and thereafter carried into the acid cleaning liquid rinsing bath in which the acid cleaning liquid is rinsed away. The metal strip 10 is then carried into the plating bath 20 in which the electroplating is performed.

The present embodiment may be further provided with a bath to perform a pretreatment such as strike plating before the electroplating is performed in the plating bath 20, and/or an electrolytic liquid rinsing bath to rinse away the plating liquid 30 attached to the metal strip 10 after the electroplating is performed in the plating bath 20.

FIG. 1 exemplifies a configuration having one plating bath 20. In an alternative embodiment, a plurality of plating baths 20 may be arranged in series depending on the necessary properties of the alloy plated layer to be formed on the metal strip 10, such as the thickness of the alloy plated layer.

The anodes 70*a* to 70*d* used in the present embodiment will then be described in detail. In the present embodiment, an anode obtained by mixing two or more kinds of pellets of metals for forming the alloy plated layer on the metal strip 10 is used as each of the anodes 70*a* to 70*d*. Specifically, when the alloy plated layer comprises an alloy of two kinds of metals, i.e., a metal $M_1$ and a metal $M_2$, an anode basket may be used after being filled with a mixture of pellets of the metal $M_1$ and pellets of the metal $M_2$. More specifically, when the alloy plated layer to be formed on the metal strip 10 is a nickel-cobalt alloy plated layer, for example, each of the anodes 70*a* to 70*d* can be configured by filling an anode basket with a mixture of nickel pellets and cobalt pellets.

When the alloy plated layer to be formed on the metal strip 10 comprises an alloy of three or more kinds of metals (e.g., an alloy of $M_1$, $M_2$ and $M_3$), each of the anodes 70*a* to 70*d* may be configured using metal pellets corresponding to these three or more kinds of metals.

In the present embodiment, a mixing ratio of each of plural kinds of metal pellets to be used as the anodes 70*a* to 70*d* may be determined as below. That is, a total surface area ratio of each kind of metal pellets that constitute the anodes 70*a* to 70*d* may be obtained so that a dissolution ratio of each kind of metal pellets that constitute the anodes 70*a* to 70*d* is a dissolution ratio corresponding to a weight ratio of each metal that constitutes the alloy plated layer to be formed on the metal strip 10, and the mixing ratio of each kind of metal pellets to be used as the anodes 70*a* to 70*d* may be determined on the basis of the total surface area ratio.

More specific determination method for the mixing ratio of each kind of metal pellets may preferably be as follows. Now assume that: respective metals that form the alloy plated layer to be formed on the metal strip 10 are represented by $M_1$, $M_2$, $M_3$, . . . and $M_n$; the dissolution ratios (unit of %) of respective kinds of metal pellets that constitute the anodes 70*a* to 70*d* are represented by $y(M_1)$, $y(M_2)$, $y(M_3)$, . . . and $y(M_n)$; and the weight ratios (unit of %) of respective metals that constitute the alloy plated layer to be formed on the metal strip 10 are represented by $z(M_1)$, $z(M_2)$, $z(M_3)$, . . . and $z(M_n)$.

In the present embodiment, the total surface area ratio of each kind of metal pellets in 10 the anodes 70*a* to 70*d* may be obtained so that the dissolution ratio of each kind of metal pellets that constitute the anodes 70*a* to 70*d* satisfies a relationship of Expression (1) below for the weight ratio of each metal that constitutes the alloy plated layer in terms of each of the $M_1$, $M_2$, $M_3$, . . . and $M_n$, and the mixing ratio of each kind of metal pellets to be used as the anodes 70*a* to 70*d* may be determined on the basis of the total surface area ratio of each kind of metal pellets.

$$z(M_x)-21 \leq y(M_x) \leq z(M_x)+21 \quad (1)$$

(where $M_1$ represents any of $M_1$, $M_2$, $M_3$, . . . and $M_n$)

It is thus preferred in the present embodiment that the total surface area ratio of each kind of metal pellets in the anodes 70*a* to 70*d* is obtained so as to satisfy the above Expression (1), and the mixing ratio of each kind of metal pellets to be used as the anodes 70*a* to 70*d* is determined on the basis of the total surface area ratio of each kind of metal pellets. More preferred is that the relationship of Expression (4) below is satisfied, and further preferred is that the relationship of Expression (5) below is satisfied.

$$z(M_x)-11 \leq y(M_x) \leq z(M_x)+11 \quad (4)$$

$$z(M_x)-5 \leq y(M_x) \leq z(M_x)+5 \quad (5)$$

(where $M_x$ represents any of $M_1$, $M_2$, $M_3$, . . . and $M_n$)

According to the present embodiment, by performing control as the above, the amounts of metal ions of $M_1$, $M_2$ and $M_3$ consumed in the plating liquid 30 due to the formation of the alloy plated layers on the metal strip 10 can be approximately the same as the amounts of metal ions of $M_1$, $M_2$ and $M_3$ supplied from the anodes. This allows the ratio and the content ratio of metal ions of each of the $M_1$, $M_2$, $M_3$, . . . and $M_n$ contained in the plating liquid 30 to be constant. Consequently, the composition of the alloy plating formed on the metal strip 10 can be stabilized.

Here, according to the present embodiment, the dissolution ratio of each kind of metal pellets can be controlled by the total surface area ratio of each kind of metal pellets in the anodes 70*a* to 70*d*. That is, the dissolution ratio of each kind of metal pellets depends on the total surface area ratio of each kind of metal pellets in the anodes 70*a* to 70*d*. Therefore, in the present embodiment, the total surface area ratio of each kind of metal pellets in the anodes 70*a* to 70*d* is controlled thereby to control the dissolution ratio of each kind of metal pellets. This allows the metal ion concentrations in the plating bath 20 to be constant, so that the composition of the alloy plated layer formed on the metal strip 10 can be stabilized.

The dissolution ratio of each kind of metal pellets as used herein refers to a weight ratio of each metal dissolved by the anode currents and can be calculated from the ion balance in the plating reaction.

The total surface area ratio of each kind of metal pellets as used herein refers to a ratio of the surface area of each kind of metal pellets to the surface area of all the metal pellets that constitute the anodes 70*a* to 70*d*. That is, when the anodes 70*a* to 70*d* comprise nickel pellets and cobalt pellets, for example, the total surface area ratio of cobalt is represented by a ratio of the surface area of all the cobalt pellets that constitute the anodes 70*a* to 70*d* to the sum of the surface area of all the nickel pellets that constitute the anodes 70*a* to 70*d* and the surface area of all the cobalt pellets. For example, when the specific surface area of nickel pellets is represented by $S_{Ni}$ [$cm^2/g$] and the compounding amount of the nickel pellets is represented by $A_{Ni}$ [g], the surface area of all the nickel pellets can be represented by $A_{Ni} \times S_{Ni}$ [$cm^2$]. When the specific surface area of cobalt pellets is represented by $S_{Co}$ [$cm^2/g$] and the compounding amount of the cobalt pellets is represented by $A_{Co}$ [g], the surface area of all the cobalt pellets can be represented by $A_{Co} \times S_{Co}$ [$cm^2$]. Therefore, according to the present embodiment, the total surface area ratio of each kind of metal pellets calculated from the compounding amount and the specific surface area may be controlled so that the dissolution ratio of each kind of metal pellets corresponds to a metal ratio (weight ratio) in the alloy plated layer to be formed on the metal strip 10. This allows the metal ion concentrations in the plating liquid 30 to be constant, so that the composition of the alloy plated layer formed on the metal strip 10 can be stabilized.

In the present embodiment, when the alloy plated layer to be formed on the metal strip 10 is a nickel-cobalt alloy plated layer, the weight ratio of cobalt may preferably be 40 to 60 wt %, i.e., the weight ratio z(Co) (unit of %) of cobalt in the nickel-cobalt alloy plated layer may preferably be within a range of $40 \leq z(Co) \leq 60$. In this case, it is preferred that the mixing ratios (weight ratios) of the nickel pellets and the cobalt pellets are as follows.

That is, when the total surface area ratio (unit of %) of the cobalt pellets contained in the anodes 70*a* to 70*d* is represented by x(Co), and the dissolution ratio (unit of %) of the cobalt pellets that constitute the anodes 70*a* to 70*d* is represented by y(Co), the mixing ratios of the nickel pellets and the cobalt pellets that constitute the anodes 70*a* to 70*d* may preferably be determined such that the x(Co) satisfies Expressions (2) and (3) below in relation to the z(Co) and the y(Co).

$$z(Co)-21 \leq y(Co) \leq z(Co)+21 \quad (2)$$

$$y(Co)=-0.8x(Co)^2/10+1.8x(Co) \quad (3)$$

Here, when the total surface area ratio (unit of %) of the nickel pellets contained in the anodes 70*a* to 70*d* is represented by x(Ni), and the dissolution ratio (unit of %) of the nickel pellets that constitute the anodes 70*a* to 70*d* is represented by y(Ni), and the weight ratio (unit of %) of nickel in the nickel-cobalt alloy plated layer is represented by z(Ni), the following equations will be satisfied in general: $x(Co)+x(Ni)=100$; $y(Co)+y(Ni)=100$; and $z(Co)+z(Ni)=100$.

According to the present embodiment, the total surface area ratio x(Co) of the cobalt pellets contained in the anodes

70*a* to 70*d* may be controlled so that the dissolution ratio y(Co) of the cobalt pellets that constitute the anodes 70*a* to 70*d* satisfies the above Expressions (2) and (3), thereby to allow the ratios and the content ratios of nickel ions and cobalt ions contained in the plating liquid 30 to be constant. Consequently, the composition of the nickel-cobalt alloy plated layer formed on the metal strip 10 can be stabilized. In view of further stabilizing the composition of the nickel-cobalt alloy plated layer, it is more preferred that Expression (6) below is satisfied, and further preferred is that Expression (7) below is satisfied.

$$z(\mathrm{Co})-11 \leq y(\mathrm{Co}) \leq z(\mathrm{Co})+11 \quad (6)$$

$$z(\mathrm{Co})-5 \leq y(\mathrm{Co}) \leq z(\mathrm{Co})+5 \quad (7)$$

The above Expression (2) is a relational expression representing a relationship between the dissolution ratio y(Co) of the cobalt pellets that constitute the anodes 70*a* to 70*d* and the weight ratio z(Co) of cobalt in the alloy plated layer. According to a knowledge of the present inventors, by setting the y(Co) to satisfy the above Expression (2) (more preferably the above Expression (6), and further preferably the above Expression (7)) in relation to the z(Co), the ratios and the content ratios of nickel ions and cobalt ions contained in the plating liquid 30 can be constant thereby to stabilize the composition of the nickel-cobalt alloy plated layer formed on the metal strip 10.

The above Expression (3) is a relational expression representing a relationship between the dissolution ratio y(Co) of the cobalt pellets that constitute the anodes 70*a* to 70*d* and the total surface area ratio x(Co) of the cobalt pellets contained in the anodes 70*a* to 70*d*. According to a knowledge of the present inventors, when the weight ratio z(Co) of cobalt in the alloy plated layer is within a range of $40 \leq z(\mathrm{Co}) \leq 60$, the y(Co) and the x(Co) satisfy the above Expression (3). Therefore, according to the present embodiment, a target dissolution ratio y(Co) of the cobalt pellets may be obtained on the basis of the above Expression (2); the obtained dissolution ratio y(Co) of the cobalt pellets may be used to obtain a target total surface area ratio x(Co) of the cobalt pellets in accordance with the above Expression (3); and the mixing ratios (weight ratios) of the nickel pellets and the cobalt pellets can be determined on the basis of the obtained total surface area ratio x(Co) of the cobalt pellets.

For example, when the weight ratio z(Co) of cobalt in the nickel-cobalt alloy plated layer is set to z(Co)=50 (i.e., 50 wt %), the dissolution ratio y(Co) of the cobalt pellets that constitute the anodes 70*a* to 70*d* may preferably be within a range of $29 \leq y(\mathrm{Co}) \leq 71$ from the above Expression (2), more preferably within a range of $39 \leq y(\mathrm{Co}) \leq 61$ from the above Expression (6), and further preferably within a range of $45 \leq y(\mathrm{Co}) \leq 55$ from the above Expression (7). In this case, the total surface area ratio x(Co) of the cobalt pellets contained in the anodes 70*a* to 70*d* may preferably be within a range of $17.5 \leq x(\mathrm{Co}) \leq 51.0$ from the above Expressions (2) and (3), more preferably within a range of $24.3 \leq x(\mathrm{Co}) \leq 41.6$ from the above Expressions (3) and (6), and further preferably within a range of $28.6 \leq x(\mathrm{Co}) \leq 36.5$ from the above Expressions (3) and (7).

Thus, as apparent from the specific numerical ranges when the weight ratio z(Co) of cobalt in the nickel-cobalt alloy plated layer is set to z(Co)=50, for example, in order to form a stable alloy plated layer in the present embodiment, the mixing ratios (weight ratios) of the metal pellets that constitute the anodes 70*a* to 70*d* may have to be in a relationship that satisfies the above expressions rather than corresponding necessarily to the metal ratios (weight ratios) of the alloy plated layer. According to the present embodiment, the total surface area ratio x(Co) of the cobalt pellets may be obtained so as to satisfy the above expressions, and the mixing ratios (weight ratios) of the nickel pellets and the cobalt pellets that constitute the anodes 70*a* to 70*d* may be obtained on the basis of the obtained total surface area ratio x(Co) of the cobalt pellets. A method of obtaining the mixing ratios (weight ratios) of the nickel pellets and the cobalt pellets from the total surface area ratio x(Co) of the cobalt pellets may be mentioned as a method of using values of the surface areas per unit weight of the nickel pellets and the cobalt pellets.

The above description is exemplified mainly with reference to the case in which the nickel-cobalt alloy plated layer is formed on the metal strip 10, but the present invention is not limited to such an embodiment.

In the present embodiment, the shape and the mixing ratio of each of the plural kinds of metal pellets used as the anodes 70*a* to 70*d* may be within the above-described ranges. However, it may be inevitable that the metal pellets used as the anodes 70*a* to 70*d* are dissolved and consumed as the plating process proceeds, in general.

In particular, when the densities of respective kinds of metal pellets are not significantly different and the target dissolution ratios are the same (1:1), the variations in the total surface area ratios of the respective kinds of metal pellets due to consumption can be suppressed and a stable alloy plated layer can thereby be formed if the respective kinds of metal pellets have the same shape and the same size. Therefore, it is preferred that the respective kinds of metal pellets have the same shape and the same size. However, even if metal pellets having the same shape and the same size are not available, or the densities of metals that constitute the respective kinds of metal pellets are different, or the target dissolution ratios are not the same (1:1), it is not necessarily required to use metal pellets having the same shape and the same size. In such a case, it is preferred to select and use metal pellets having shapes and sizes that can reduce the variations in the total surface area ratios of the respective kinds of metal pellets due to consumption. In particular, by adjusting the shapes and the sizes of the respective kinds of metal pellets, the variation in the surface area of each metal pellet due to consumption can be predicted even if the respective kinds of metal pellets do not necessarily have the same shape and the same size. Therefore, if such variations in the surface areas are synchronized between the respective kinds of metal pellets, the variations in the total surface area ratios of the respective kinds of metal pellets due to consumption can be effectively suppressed, and a stable alloy plated layer can thereby be formed.

In addition to the above method, according to the present embodiment, also by regularly supplementing the respective kinds of metal pellets at predetermined ratios in order to supplement the consumed metal pellets as will be described later, it is possible to suppress the variations in the total surface area ratios of the respective kinds of metal pellets due to the effect of the metal pellets which have already been consumed.

In the present embodiment, with consideration for stabilizing the composition of the alloy plated layer to be formed on the metal strip 10, it is preferred that the current density when performing the electroplating is 1 to 40 A/dm$^2$ and the pH of the plating liquid 30 is 1.5 to 5. It is also preferred that the temperature of the plating liquid 30 (bath temperature) is 40° C. to 80° C. If the current density when performing the electroplating is unduly high or unduly low, or the pH of the plating liquid 30 is unduly high or unduly low, or the temperature of the plating liquid 30 is unduly high or unduly low, the composition of the alloy plated layer to be formed may possibly be unstable.

In the present embodiment, as the plating process proceeds, the respective kinds of metal pellets will be dissolved and consumed. Therefore, it is preferred to regularly supplement the respective kinds of metal pellets into the anode basket. The supplemental ratio of each kind of metal pellets when supplementing the metal pellets may preferably be, but is not particularly limited to, a ratio corresponding to the weight ratio of each metal that constitutes the alloy plated layer. For example, the alloy plated layer to be formed on the metal strip 10 is a nickel-cobalt alloy plated layer with a content ratio of cobalt of 50 wt %, the ratio of each kind of metal pellets may be set such that a weight ratio of "nickel pellets:cobalt pellets" is 1:1. In particular, each kind of metal pellets in the anodes 70*a* to 70*d* dissolves with a weight ratio corresponding to the composition ratio of the alloy plated layer to be formed. Therefore, when supplementing the metal pellets according to the present embodiment, the supplement may preferably be performed with a ratio corresponding to the weight ratio of each metal that constitutes the alloy plated layer, thereby to allow the alloy plated layer to be formed stably. Thus, when supplementing the metal pellets according to the present embodiment, each kind of metal pellets may be supplemented with a ratio corresponding to the weight ratio of each metal that constitutes the alloy plated layer. Therefore, even if the metal pellets are consumed as the plating proceeds, the metal pellets can be readily supplemented.

The timing of performing the supplement of metal pellets is not particularly limited. However, if the metal pellets dissolve to reduce the total surface area, i.e., the surface area of all the metal pellets that constitute the anodes 70*a* to 70*d* decreases, the current density of the anodes or the cathode may deviate from a set range. Therefore, the pellets may preferably be supplemented continuously.

In the present embodiment, the metal pellets to be used as the anodes 70*a* to 70*d* are not particularly limited, but each metal pellet to be used may preferably have a representative length (which refers to the diameter in a case of spherical pellets, or in a case of other shape, refers to the maximum length of the shape) of 5 to 50 mm (preferably 5 to 40 mm) and a volume of 60 to 5,000 $mm^3$. According to the present embodiment, by using the pellets having such representative length and volume, the metal pellets can be continuously supplemented with desired weight ratios when supplementing the metal pellets, while stabilizing the total surface area ratios without significant variations. Moreover, the specific surface area can be suppressed from varying due to consumption thereby to suppress the variation in the total surface area of each kind of metal pellets, and the total surface area ratio of each kind of metal pellets can thus be suppressed from varying. Furthermore, by using the pellets having such representative length and volume, the metal pellets added during the supplement can suppress the variation in the total surface area ratio of each kind of metal pellets due to the effect of the metal pellets which have already been consumed, and a sufficient stability can thus be obtained.

In particular, if the representative length of the metal pellets is unduly large, the total surface area significantly varies when the metal pellets are added for supplement, so that the total surface area is unlikely to be stable, because the weight and the surface area of each metal pellet are large. In particular, when metal pellets having different sizes are used as the respective kinds of metal pellets, if the supplement of the metal pellets is performed in terms of the weight ratios as described above, the total surface area ratio of each kind of metal pellets readily varies, which may be undesirable. In such circumstances, as a result of intensive studies with consideration for the plating rate and the size of anode basket which are industrially available; the size of the metal strip 10 to be plated with coating; and the scale of the plant, the inventors have found that the metal pellets having a representative length and a volume within the above ranges can be used thereby to suppress the variations in the total surface areas and the total surface area ratio of each kind of metal pellets due to the supplement. Therefore, in view of suppressing such variations in the total surface areas and the total surface area ratio of each kind of metal pellets due to the supplement, it is preferred in the present embodiment to use the metal pellets having a representative length and a volume within the above ranges.

However, if the size or volume of the metal pellets to be used (the initial size before being consumed) is unduly large, the difference between the specific surface area of the initial metal pellets before being consumed and that of the metal pellets after being consumed will be large. This may cause the total surface area ratio of each kind of metal pellets to considerably vary due to consumption. As a result of the above, the composition of the alloy plated layer to be formed will be unstable, which may not be desirable. In addition, unduly large representative length of the metal pellets may make it difficult to fill the anode basket with the metal pellets with no spaces so that the filling rate is reduced, and there will possibly be hollow spaces in which no pellets exist. In this case, the solubility into the plating liquid 30 may also deteriorate.

If, on the other hand, the representative length is unduly small or the volume is unduly small, the pellets may bound or drop when filling the anode basket, causing poor handling ability, and the pellets may come out from the mesh of the anode basket and get jammed to project between the anode basket and an anode bag which is provided outside the anode basket. Unduly large representative length may make it difficult to fill the anode basket with the metal pellets with no spaces so that the filling rate is reduced, and there will possibly be hollow spaces in which no pellets exist. In this case, the solubility into the plating liquid 30 may also deteriorate.

In contrast, by using the metal pellets having a representative length of 5 to 50 mm and a volume of 60 to 5,000 $mm^3$, the metal pellets can be continuously supplemented with desired weight ratios when supplementing the metal pellets, while stabilizing the total surface area ratios without significant variations. Moreover, the specific surface area can be suppressed from varying due to consumption thereby to suppress the variation in the total surface area of each kind of metal pellets. Furthermore, by using the metal pellets having such representative length and volume, the metal pellets added during the supplement can suppress the variation in the total surface area ratio of each kind of metal pellets due to the effect of the metal pellets which have already been consumed, and a sufficient stability can thus be obtained.

In the present embodiment, the shape of metal pellets used for the anodes 70*a* to 70*d* is not particularly limited, but there may preferably be used spherical, ellipsoidal, cylindrical, coin-like or other such shapes. In particular, by using the metal pellets of such a shape to fill the anodes 70*a* to 70*d*, even when the metal pellets are consumed (dissolved) and become small as the electroplating proceeds, the initial shape can be maintained to some extent of size. In addition, when dissolution further proceeds, the shape of metal pellets comes finally to spherical shape, and hence, calculation or prediction of the total surface area ratio of each kind of metal pellets due to consumption can be easily performed. This may be advantageous because the total surface area ratio of each kind of metal pellets can be easily stabilized.

In the present embodiment, metal salt compound powder may appropriately be added to the plating liquid in order to adjust the concentration of the plating liquid. Preferably, the additive amount of the metal salt compound powder may appropriately be set within a range that does not impair the action and effect of the present invention.

In the present embodiment, when the alloy plated layer is formed on the metal strip 10 by means of electroplating, an anode obtained by mixing two or more kinds of metal pellets for forming the alloy plated layer is used as each of the anodes (positive electrodes) 70*a* to 70*d*. Therefore, according to the present embodiment, the metal ion concentrations in the plating liquid included in the plating bath can be suppressed from varying. This allows the alloy plated layer to be formed stably on the metal strip 10. In particular, according to the present embodiment, there may not occur a trouble that the counterpart anions increase, which would occur when employing a method of adding metal salt compound powders to the plating liquid and dissolving them in the plating liquid. It is therefore possible to effectively prevent the problem in association with the above trouble, i.e., the problem in that a target composition and desired properties of the plated film cannot be stably obtained.

In addition, according to the present embodiment, by varying the compounding ratios of the metal pellets for forming the alloy plated layer, the dissolution ratios of the anodes can be finely set. This allows the alloy plated layer to have an alloy composition which can be finely selected from a wide variety of composition ranges.

In particular, when a nickel-cobalt alloy plated layer is formed, there may be exemplified a method in which nickel electrodes and cobalt electrodes are used as anodes and these electrodes act as supply sources for nickel ions and cobalt ions. This method may involve problems as below.

Figure 2:
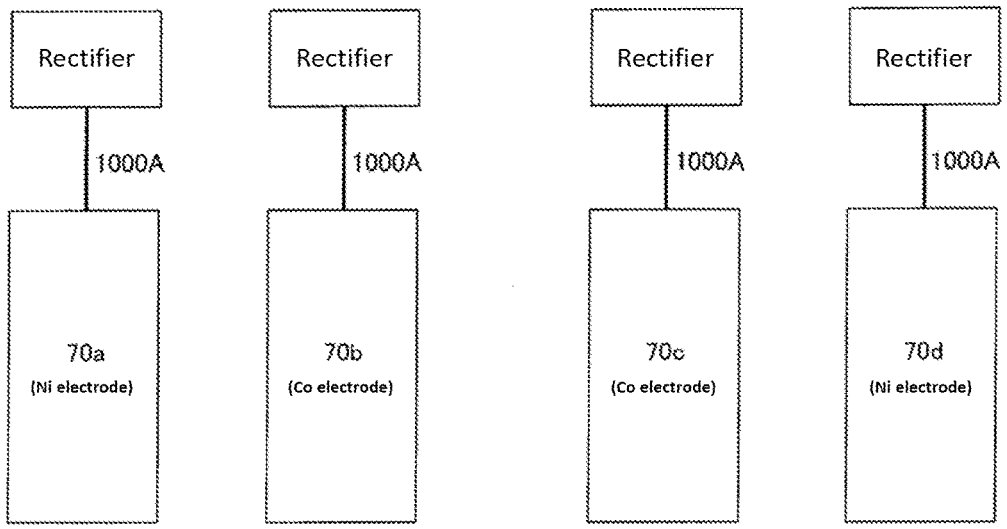
FIG. 2 is a diagram for explaining a plating method according to a conventional example.

For example, as shown in FIG. 2, the plating line shown in FIG. 1 may be configured such that: the anodes 70*a* and 70*d* that constitute a part of the plating line are provided as nickel electrodes; the anodes 70*b* and 70*c* that constitute a part of the plating line are provided as cobalt electrodes; and a current of 1,000 A flows through each of the anodes 70*a* to 70*d* in order to form nickel-cobalt alloy plated layers having a ratio of nickel and cobalt of 1:1 in molar ratio. In this example, one surface of the metal strip 10 (the surface close to the anodes 70*a* and 70*d*) will be formed thereon with an alloy layer having a nickel-rich composition while the other surface (the surface close to the anodes 70*b* and 70*c*) will be formed thereon with an alloy layer having a cobalt-rich composition, thus causing a composition variation.

Figure 3:
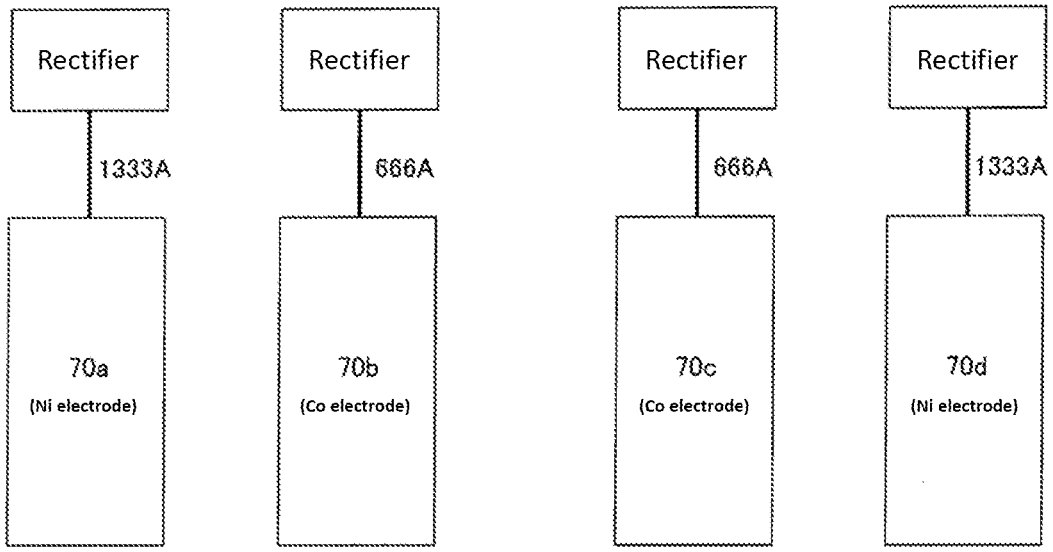
FIG. 3 is a diagram for explaining a plating method according to a conventional example.

As shown in FIG. 3, another example may be used such that: the anodes 70*a* to 70*d* are configured as with the example shown in FIG. 2; a current to flow through each of the anodes 70*a* and 70*d* is set to 1,333 A; and a current to flow through each of the anodes 70*b* and 70*c* is set to 666 A, in order to form nickel-cobalt alloy plated layers having a ratio of nickel and cobalt of 2:1 in molar ratio. In this example, one surface of the metal strip 10 (the surface close to the anodes 70*a* and 70*d*) will be formed thereon with an alloy layer having a nickel-rich composition while the other surface (the surface close to the anodes 70*b* and 70*c*) will be formed thereon with an alloy layer having a cobalt-rich composition, thus causing a composition variation, as with the above example shown in FIG. 2. In addition, in this example shown in FIG. 3, a trouble may occur that the ratio of the thickness of the alloy layer formed on the surface close to the anodes 70*a* and 70*d* and the thickness of the alloy layer formed on the surface close to the anodes 70*b* and 70*c* is a ratio that depends on the current amounts, i.e., a ratio of 2:1. Furthermore, a coating film may not possibly be obtained with desired properties because of the different current densities.

Figure 4:
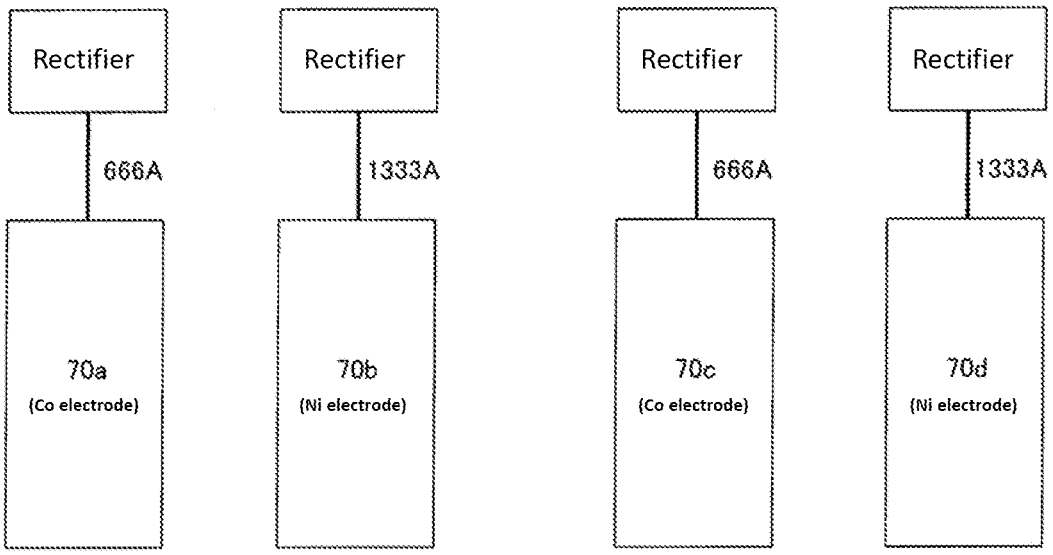
FIG. 4 is a diagram for explaining a plating method according to a conventional example.

As shown in FIG. 4, a further example may be used such that: the anodes 70*b* and 70*d* that constitute a part of the plating line are provided as nickel electrodes; the anodes 70*a* and 70*c* that constitute a part of the plating line are provided as cobalt electrodes; and nickel-cobalt alloy plated layers are formed to have a ratio of nickel and cobalt of 2:1 in molar ratio as with the above example shown in FIG. 3. In this case, different from the above case of FIG. 3, the ratio of the thickness of the alloy layer formed on the surface close to the anodes 70*a* and 70*d* and the thickness of the alloy layer formed on the surface close to the anodes 70*b* and 70*c* can be even, but the problem of causing a composition variety still remains. Also in this case, a coating film may not possibly be obtained with desired properties because of the different current densities.

In addition, in the examples shown in FIG. 2 to FIG. 4, the current amount to be supplied to each of the anodes 70*a* to 70*d* may have to be controlled independently. Therefore, different from the example shown in FIG. 1, respective rectifies are required to be used for the anodes 70*a* to 70*d* (i.e., four rectifiers are required in the examples shown in FIG. 2 to FIG. 4). Thus, a problem may arise in that the manufacturing cost increases compared with the example shown in FIG. 1.

Figure 5:
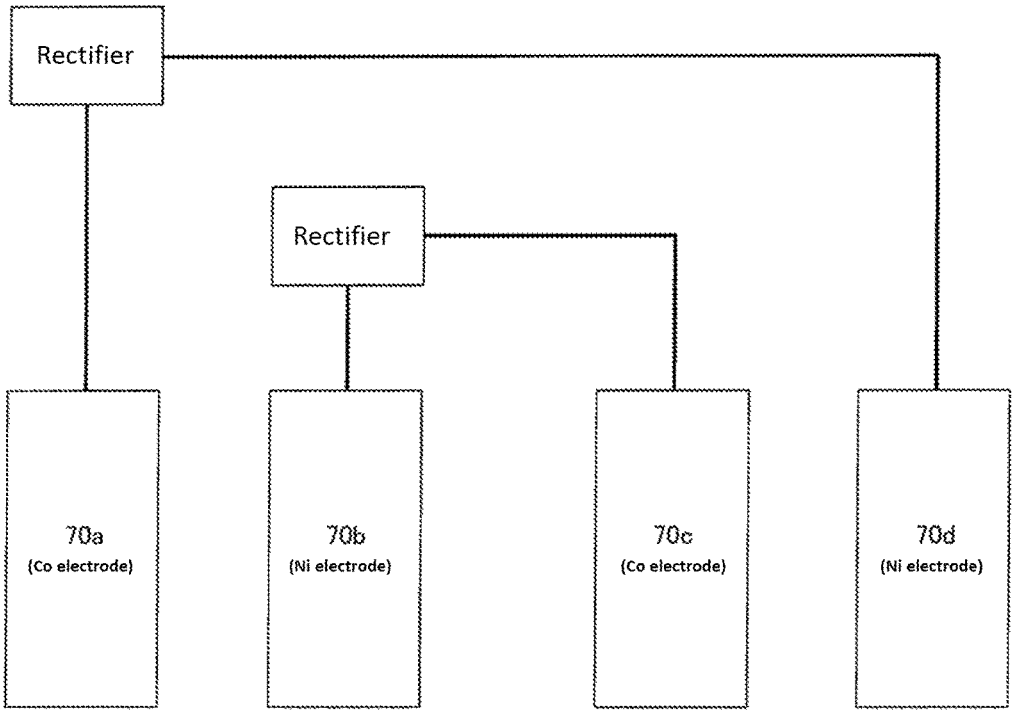
FIG. 5 is a diagram for explaining a plating method according to a conventional example.

To overcome such a problem, as shown in FIG. 5, it may be proposed to provide two rectifiers in the example shown in FIG. 4, for example. A possible trouble in this case will be explained with reference to the anodes 70*a* and 70*d*, for example. That is, despite the intention to flow a current of 1,000 A evenly through each of the anodes 70*a* and 70*d*, the current of 1,000 A cannot flow evenly through each anode because of being affected by the resistance of a current line to each anode or the like. Accordingly, the composition of the alloy layer to be obtained may not be appropriately controlled.

In contrast, according to the present embodiment, the compounding ratios of respective kinds of metal pellets for forming the alloy plated layer can be varied thereby to finely set the dissolution ratios of the anodes. In addition, the ratio of metal ions supplied from each anode can be even. Therefore, the troubles as in the above examples shown in FIG. 2 to FIG. 5 can be effectively prevented from occurring.

EXAMPLES

The present invention will hereinafter be more specifically described with reference to Examples, but the present invention is not limited to these Examples.

Example 1

First, a steel strip (thickness of 0.2 mm and width of 200 mm) having a chemical composition as below was prepared:

C: 0.039 wt/%, Mn: 0.02 wt %, Si: 0.22 wt %, P: 0.016 wt %, S: 0.008 wt %, and the balance: Fe and unavoidable impurities.

After electrolytic degreasing, water washing, acid washing with sulfuric acid, and further water washing for the prepared steel strip in this order, a process was performed to continuously form nickel-cobalt alloy plated layers on the surfaces of the steel strip using the plating line shown in FIG. 1. The nickel-cobalt alloy plated layers were thus continuously formed on the steel strip with a ratio of "nickel:cobalt" of 50:50 (weight ratio), i.e., with a weight ratio z(Co) of cobalt in the alloy plated layers of z(Co)=50. The ratio of "nickel:cobalt" was measured through: forming the nickel-cobalt alloy plated layers; thereafter dissolving the nickel-cobalt alloy plated layers thus formed; and performing ICP emission spectroscopic analysis for the dissolved substance thus obtained.

Specifically, the process was performed to continuously form the nickel-cobalt alloy plated layers under a condition of a current density for each of the anodes 70*a* to 70*d*: 10 A/dm$^2$ and plating time: 8 hours, while stirring 2 L of the plating liquid 30.

An anode obtained by filling an anode basket with a mixture of 1,469 g of spherical nickel pellets (specific surface area: 0.6 cm$^2$/g, diameter: 10.7 mm) and 733 g of coin-like cobalt pellets (specific surface area: 0.6 cm$^2$/g, diameter in a surface perpendicular to the thickness direction: 34.0 mm) was used as each of the anodes 70*a* to 70*d*. Namely, an anode of nickel pellets (x(Ni)):cobalt pellets (x(Co))=66.7:33.3 (surface area ratio) was used.

In the present Example, the plating liquid as below was used as the plating liquid 30:

bath composition: nickel sulfate, nickel chloride, cobalt sulfate, cobalt chloride, and boric acid with the contents of nickel ion concentration: 65.4 g/L and cobalt ion concentration: 12.6 g/L;

pH: 3.5 to 5.0; and bath temperature: 60° C.

Figure 6:
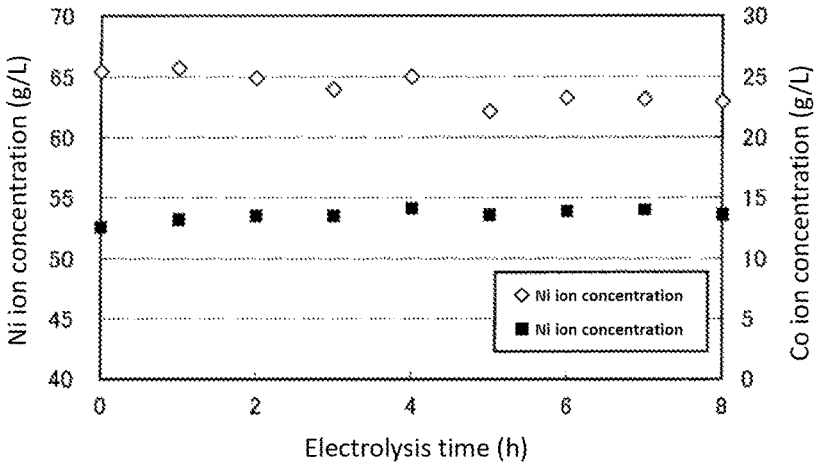
FIG. 6 is a set of graphs each showing measurement results of an amount of nickel ions and an amount of cobalt ions when the plating is performed in Examples.
Figure 6:
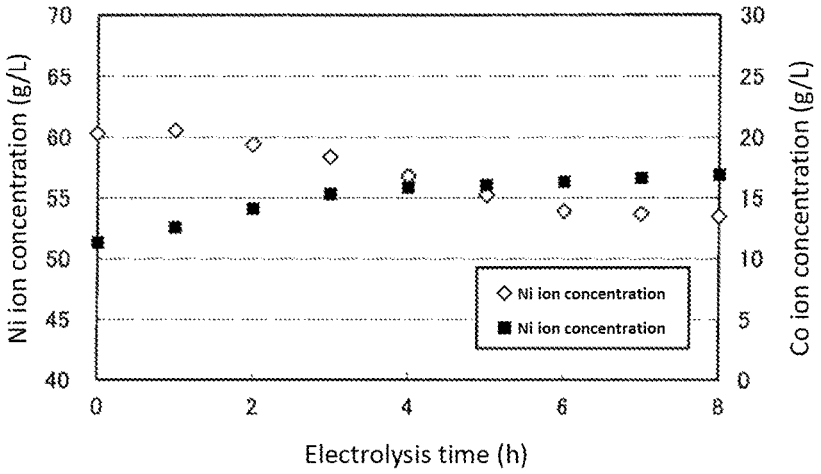
Figure 6:
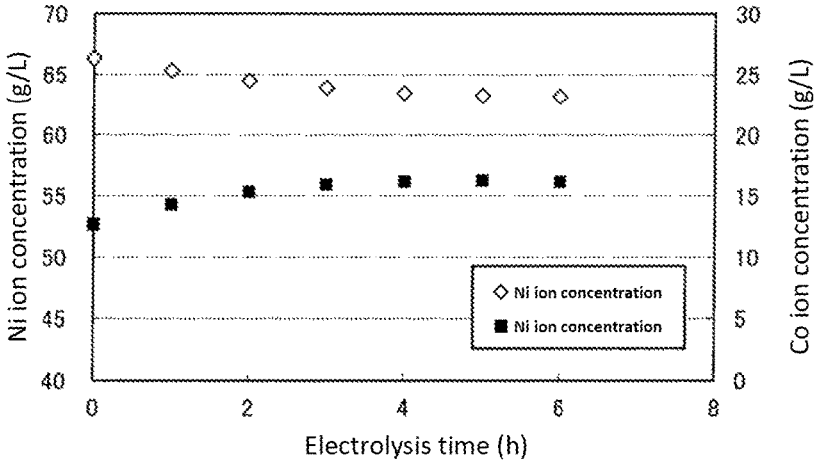

In the present Example, the stability of the plating liquid was evaluated by measuring the nickel ion concentration and the cobalt ion concentration in the plating liquid every 1 hour during 8 hours of the plating process. Measurement results of the nickel ion concentration and the cobalt ion concentration during 8 hours of the plating process are shown in FIG. 6(A).

Example 2

Nickel-cobalt alloy plated layers were continuously formed on a steel strip by performing the electroplating like in Example 1 except for using an anode obtained by filling an anode basket with a mixture of 974 g of spherical nickel pellets (specific surface area: 0.6 cm$^2$/g, diameter: 10.7 mm) and 985 g of coin-like cobalt pellets (specific surface area: 0.6 cm$^2$/g, diameter in a surface perpendicular to the thickness direction: 34.0 mm) as each of the anodes 70*a* to 70*d* (nickel pellets (x(Ni)):cobalt pellets (x(Co))=49.7:50.3 (surface area ratio)). Measurement results of the nickel ion concentration and the cobalt ion concentration during 8 hours of the plating process are shown in FIG. 6(B).

Example 3

Nickel-cobalt alloy plated layers were continuously formed on a steel strip by performing the electroplating like in Example 1 except for using an anode obtained by filling an anode basket with a mixture of 1,684 g of spherical nickel pellets (specific surface area: 0.6 cm$^2$/g, diameter: 10.7 mm) and 558 g of coin-like cobalt pellets (specific surface area: 0.6 cm$^2$/g, diameter in a surface perpendicular to the thickness direction: 34.0 mm) as each of the anodes 70*a* to 70*d* (nickel pellets (x(Ni)):cobalt pellets (x(Co))=75.1:24.9 (surface area ratio)). In Example 3, the plating process time was changed from 8 hours to 6 hours. Measurement results of the nickel ion concentration and the cobalt ion concentration during 6 hours of the plating process are shown in FIG. 6(C).

Comparative Example 1

Figure 7:
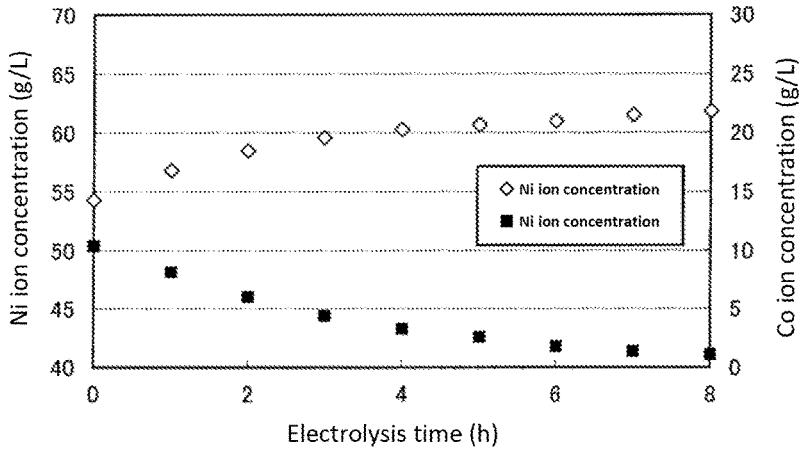
FIG. 7 is a set of graphs each showing measurement results of an amount of nickel ions and an amount of cobalt ions when the plating is performed in Comparative Examples.
Figure 7:
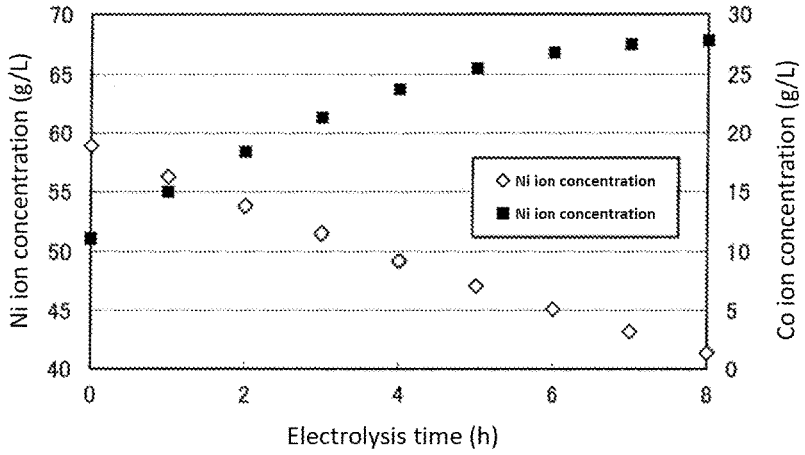

Nickel-cobalt alloy plated layers were continuously formed on a steel strip by performing the electroplating like in Example 1 except for using an anode obtained by filling an anode basket only with 2,222 g of spherical nickel pellets (specific surface area: 0.6 cm$^2$/g, diameter: 10.7 mm) as each of the anodes 70*a* to 70*d*. Measurement results of the nickel ion concentration and the cobalt ion concentration during 8 hours of the plating process are shown in FIG. 7(A).

Comparative Example 2

Nickel-cobalt alloy plated layers were continuously formed on a steel strip by performing the electroplating like in Example 1 except for using an anode obtained by filling an anode basket only with 1,738 g of coin-like cobalt pellets (specific surface area: 0.6 cm$^2$/g, diameter in a surface perpendicular to the thickness direction: 34.0 mm) as each of the anodes 70*a* to 70*d*. Measurement results of the nickel ion concentration and the cobalt ion concentration during 8 hours of the plating process are shown in FIG. 7(B).

Evaluation

As shown in FIG. 6(A) to FIG. 6(C), according to Examples 1 to 3 in which an anode obtained by filling an anode basket with a mixture of nickel pellets and cobalt pellets was used as each of the anodes 70*a* to 70*d*, the variations in the nickel ion concentration and the cobalt ion concentration were able to be appropriately suppressed during 8 hours (or 6 hours) of the plating process. The composition of the nickel-cobalt alloy plated layers formed on the steel strip was thereby possible to be stabilized. In particular, according to Example 1 in which an anode of nickel pellets (x(Ni)):cobalt pellets (x(Co))=66.7:33.3 (surface area ratio) was used as each of the anodes 70*a* to 70*d*, the nickel ion concentration and the cobalt ion concentration were able to be constant during 8 hours of the plating process. The composition of the nickel-cobalt alloy plated layers formed on the steel strip was thus possible to be approximately uniform.

In contrast, as shown in FIG. 7(A) and FIG. 7(B), according to Comparative Example 1 in which only nickel pellets were used as the anodes 70*a* to 70*d* or Comparative Example 2 in which only cobalt pellets were used as the anodes 70*a* to 70*d*, results were such that the variations in the nickel ion concentration and the cobalt ion concentration were large during 8 hours of the plating process, and therefore the composition of the nickel-cobalt alloy plated layers formed on the steel strip also varied.

Figure 8:
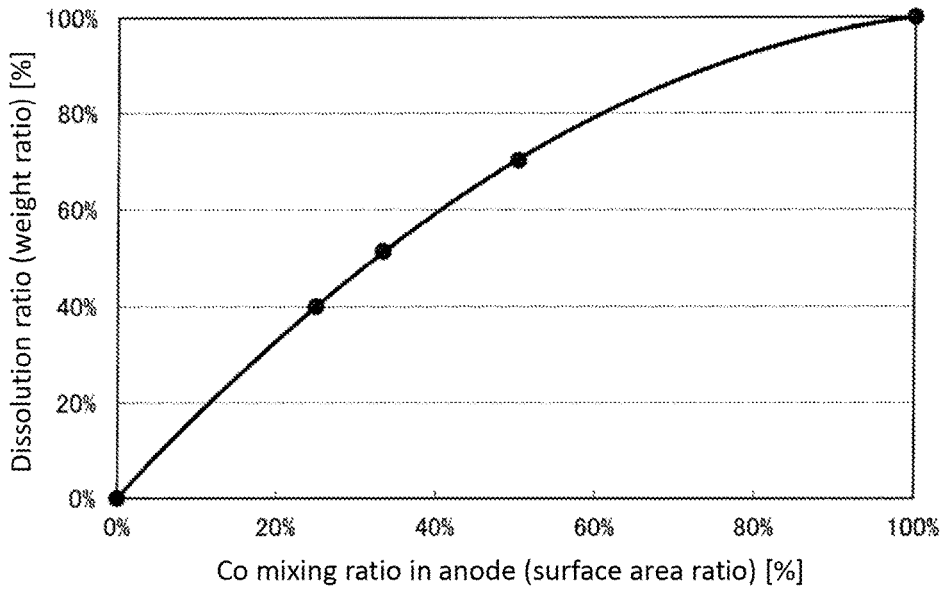
FIG. 8 is a graph showing a relationship between a cobalt mixing ratio (surface area ratio) in anodes 70*a* to 70*d* and a cobalt dissolution ratio (weight ratio).

FIG. 8 shows a relationship between the cobalt ratio (surface area ratio) in the anodes 70*a* to 70*d* and the cobalt dissolution ratio (weight ratio) calculated from the ion balance in Examples 1 to 3 and Comparative Examples 1 and 2. As shown in FIG. 8, as the cobalt mixing ratio in the anodes increases (as the nickel mixing ratio decreases), the cobalt dissolution ratio of the anodes 70*a* to 70*d* tends to also increase (the nickel dissolution ratio decreases). This tendency can be confirmed to have a certain relationship ($y(Co)=-0.8x(Co)^2/100+1.8x(Co)$).

Table 1 shows a relationship among the total surface area ratio x(Co) of the cobalt pellets in the anodes 70*a* to 70*d*, the dissolution ratio y(Co) of the cobalt pellets, and evaluation results of the stability of the plating liquid. In Table 1, the stability of the plating liquid was evaluated with the criteria below. That is, the evaluation was conducted with the criteria below on the basis of the degree of instability during 6 hours of each metal ion concentration (g/L) that constitutes the plating liquid (i.e., the difference between the maximum value and the minimum value during 6 hours). As the degree of instability is small, the plating liquid can be evaluated to be stable.

A: The degree of instability is not larger than 5 g/L and the deviation from the initial value is within ±3.5 g/L.

B: The degree of instability is not larger than 5 g/L and the deviation from the initial value is beyond ±3.5 g/L.

C: The degree of instability is not larger than 8 g/L.

D: The degree of instability is larger than 8 g/L.

TABLE 1

| | x(Co) | y(Co) | Stability of plating liquid |
|---|---|---|---|
| Example 1 | 33.3 | 51.4 | A |
| Example 2 | 50.3 | 70.2 | C |
| Example 3 | 24.9 | 39.9 | B |
| Comparative Example 1 | 0 | 0 | D |
| Comparative Example 2 | 100 | 100 | D |

As apparent from the results of Table 1, it can be confirmed that Examples 1 to 3, in particular Examples 1 and 3, are excellent in the stability of the plating liquid.

DESCRIPTION OF REFERENCE NUMERALS

10 . . . Metal strip
20 . . . Plating bath
30 . . . Plating liquid
40, 60 . . . Conductor roll
50 . . . Sink roll
70*a*, 70*b*, 70*c*, 70*d* . . . Anode
80*a*, 80*b* . . . Rectifier

The invention claimed is:

1. A method of manufacturing a metal sheet having a layer plated with a nickel-cobalt alloy comprising:

preparing a plating bath comprising a plating liquid and an anode, the plating liquid containing nickel ions and cobalt ions for forming the layer; and passing a metal strip continuously through the plating bath to perform electroplating in the plating bath, wherein the anode is obtained by filling an anode basket with a mixture of a nickel pellet and a cobalt pellet, a weight ratio z(Co), which unit is %, of cobalt in the layer is within a range of $40 \leq z(Co) \leq 60$, and the mixing ratios of the nickel pellet and the cobalt pellet that constitute the anode are determined such that a total surface area ratio x(Co), which unit is %, of the cobalt pellet satisfies Expressions (2) and (3) below in relation to the z(Co) and a dissolution ratio y(Co) (unit of %) of the cobalt pellet that constitutes the anode $$z(Co)-21 \leq y(Co) \leq z(Co)+21 \quad (2)$$

$$y(Co)=-0.8x(Co)^2/10+1.8x(Co) \quad (3)$$

2. The method of manufacturing a metal sheet according to claim 1, wherein when the electroplating is performed in the plating bath while supplementing the nickel pellet and the cobalt pellet into the anode, a supplemental ratio of the cobalt pellet is set to a ratio corresponding to the weight ratio z(Co).

3. The method of manufacturing a metal sheet according to claim 1, wherein the nickel pellet and the cobalt pellet have a representative length of 5 to 50 mm and a volume of 60 to 5,000 $mm^3$.

4. The method of manufacturing a metal sheet according to claim 1, wherein the plating bath is based on a Watts bath.

* * * * *